US010858959B2

(12) United States Patent
Maar

(10) Patent No.: US 10,858,959 B2
(45) Date of Patent: Dec. 8, 2020

(54) AXIALLY DIVIDED TURBOMACHINE INNER RING

(71) Applicant: MTU Aero Engines AG, Munich (DE)

(72) Inventor: Karl Maar, Pfaffenhofen an der Ilm (DE)

(73) Assignee: MTU Aero Engines AG, Munich (DE)

( * ) Notice: Subject to any disclaimer, the term of this patent is extended or adjusted under 35 U.S.C. 154(b) by 182 days.

(21) Appl. No.: 15/992,374

(22) Filed: May 30, 2018

(65) Prior Publication Data

US 2018/0355761 A1 Dec. 13, 2018

(30) Foreign Application Priority Data

Jun. 8, 2017 (DE) ..... 10 2017 209 682

(51) Int. Cl.
*F01D 25/24* (2006.01)
*F01D 9/04* (2006.01)
*F01D 11/00* (2006.01)

(52) U.S. Cl.
CPC ..... *F01D 25/246* (2013.01); *F01D 9/042* (2013.01); *F01D 11/001* (2013.01); *F05D 2230/64* (2013.01); *F05D 2230/644* (2013.01); *F05D 2240/12* (2013.01); *F05D 2260/30* (2013.01)

(58) Field of Classification Search
CPC ..... F01D 25/246; F01D 11/001; F01D 9/042; F05D 2260/30; F05D 2230/64; F05D 2230/644
USPC ..... 416/160; 415/182.1
See application file for complete search history.

(56) References Cited

U.S. PATENT DOCUMENTS 3,829,233 A 8/1974 Scalzo et al.
4,792,277 A * 12/1988 Dittberner, Jr. ..... F01D 11/001 415/160
5,062,767 A * 11/1991 Worley ..... F01D 9/042 415/190
5,328,327 A 7/1994 Naudet et al.
5,421,703 A * 6/1995 Payling ..... F01D 9/042 415/209.3
5,487,642 A * 1/1996 Norton ..... F01D 9/023 415/209.2
6,790,000 B2 * 9/2004 Wolf ..... F01D 17/162 415/165
7,458,771 B2 * 12/2008 Abadie ..... F01D 9/042 415/160

(Continued)

FOREIGN PATENT DOCUMENTS

DE 10161292 6/2003
DE 10351202 A1 6/2005

(Continued)

*Primary Examiner* — J. Todd Newton
(74) *Attorney, Agent, or Firm* — Davidson, Davidson & Kappel, LLC

(57) ABSTRACT

An axially divided inner ring is provided for fastening to, in particular adjustable, guide vanes (50) of a turbomachine, in particular a compressor or turbine stage of a gas turbine, which includes a first partial ring (10) and a second partial ring (20), which is supported in the axial direction directly or indirectly on two axially facing support surfaces (11, 12) of the first partial ring (10) and is fixed on the first partial ring (10) in the radial direction with the aid of multiple alignment pins (40) distributed in the circumferential direction.

22 Claims, 2 Drawing Sheets

(56) References Cited

U.S. PATENT DOCUMENTS

| | | | | |
|---|---|---|---|---|
| 7,510,369 | B2 * | 3/2009 | Lytle | F01D 17/162 415/160 |
| 7,690,889 | B2 | 4/2010 | Giaimo et al. | |
| 8,240,043 | B2 | 8/2012 | Duesler et al. | |
| 9,790,813 | B2 | 10/2017 | Kraus et al. | |
| 2007/0177973 | A1 | 8/2007 | Seki et al. | |
| 2007/0286719 | A1 * | 12/2007 | Duesler | F01D 11/001 415/191 |
| 2008/0219832 | A1 * | 9/2008 | Major | F01D 17/162 415/65 |
| 2012/0257963 | A1 * | 10/2012 | Major | F01D 17/162 415/182.1 |
| 2012/0263571 | A1 | 10/2012 | Ress | |
| 2014/0328672 | A1 * | 11/2014 | Brandl | F01D 9/04 415/139 |
| 2014/0348449 | A1 | 11/2014 | Zotz | |
| 2015/0071768 | A1 | 3/2015 | Hugon et al. | |
| 2015/0275916 | A1 | 10/2015 | Marshall et al. | |
| 2016/0123188 | A1 * | 5/2016 | Maliniak | F01D 25/243 415/209.4 |
| 2016/0208637 | A1 * | 7/2016 | Maliniak | F01D 17/162 |
| 2016/0237855 | A1 * | 8/2016 | Humhauser | F01D 11/001 |
| 2016/0238028 | A1 * | 8/2016 | Humhauser | F01D 11/001 |
| 2016/0363133 | A1 * | 12/2016 | Mouton | F01D 17/162 |
| 2018/0355761 | A1 * | 12/2018 | Maar | F01D 9/042 |

FOREIGN PATENT DOCUMENTS

| | | | |
|---|---|---|---|
| DE | 102005042747 | A1 | 3/2007 |
| DE | 102007015669 | A1 | 10/2008 |
| DE | 102013203870 | A1 | 9/2014 |
| EP | 1757776 | A2 | 2/2007 |
| EP | 1760272 | A2 | 3/2007 |
| EP | 1788199 | A2 | 5/2007 |
| EP | 2093380 | A2 | 8/2009 |
| EP | 1635039 | B1 | 9/2010 |
| EP | 2261467 | A2 | 12/2010 |
| EP | 1967718 | B1 | 6/2013 |
| EP | 2716874 | A1 | 4/2014 |
| EP | 2787180 | A1 | 10/2014 |
| EP | 2806107 | A1 | 11/2014 |
| EP | 3056683 | A1 | 8/2016 |
| EP | 2093380 | B1 | 1/2017 |
| FR | 2874977 | A1 | 3/2006 |
| FR | 2994453 | A1 | 2/2014 |
| GB | 2518945 | | 4/2015 |
| WO | WO2013150224 | A1 | 10/2013 |
| WO | WO2014046965 | A1 | 3/2014 |
| WO | WO2014052345 | A1 | 4/2014 |
| WO | WO2014058505 | A2 | 4/2014 |
| WO | WO2014143445 | A2 | 9/2014 |
| WO | WO2015031058 | A1 | 3/2015 |

* cited by examiner

AXIALLY DIVIDED TURBOMACHINE INNER RING

This claims the benefit of German Patent Application DE102017209682.9, filed Jun. 8, 2017 and hereby incorporated by reference herein.

The present invention relates to an axially divided inner ring for fastening, in particular adjustable, guide vanes of a turbomachine, in particular a compressor or turbine stage of a gas turbine, a guide baffle and a turbomachine, in particular a gas turbine, including the inner ring, as well as a method for its manufacture and assembly.

BACKGROUND

A gas turbine is known from DE 103 51 202 A1, which includes an inner ring, axially divided into two partial rings, which is fastened to adjustable guide vanes, the partial rings being screwed to each other.

SUMMARY OF THE INVENTION

It is an object of the present invention to improve an axially divided inner ring.

The present invention provides an inner ring. The present invention also provides a guide baffle and a turbomachine, which includes (at least one) inner ring described herein or a method for manufacturing or assembling an inner ring described herein. Advantageous specific embodiments of the present invention are also provided.

According to one embodiment of the present invention, (at least) one axially divided inner ring, on which, in particular adjustable guide vanes of a guide baffle for a turbine machine, in particular a compressor or turbine stage of a gas turbine, in particular of an aircraft engine, is or becomes fastened, in particular rotatably supported, or is configured or used for this purpose, includes a first and a second partial ring, the second partial ring being supported in the axial direction on two axially facing support surfaces of the first partial ring, in particular directly or immediately (on the support surfaces) or indirectly via at least one spring means, and is or becomes fixed on the first partial ring in the radial direction with the aid of multiple alignment pins distributed in the circumferential direction.

In one embodiment, the functionality of a screw connection for fixing the two partial rings to each other in both the radial direction and the axial direction, is distributed to the alignment pins and the support. In one embodiment, in particular, the assembly may be improved hereby, the installation space reduced and/or the reliability, in particular the strength, of the connection may be improved, in particular compared to a screw connection.

In the present case, the direction indication "axial" relates according to usual practice to a direction in parallel to a rotation or (main) machine axis of the turbomachine, the direction indication "circumferential direction" correspondingly relates to a rotation direction around this rotation or (main) machine axis, and the direction indication "radial" relates to a direction which is perpendicular to the axial and circumferential directions.

In one embodiment, the second partial ring is clamped, in particular elastically, in the axial direction between the two facing support surfaces of the first partial ring.

In one embodiment, the fixing with the aid of the alignment pins may be supported hereby in a frictionally engaged manner in the radial direction, or it may relieve (them), and/or clearance in the axial direction may be reduced or avoided.

In one embodiment, the second partial ring has at least one, in particular radially inner or internal annular or circumferential groove for reducing its stiffness in the axial direction, which in one refinement communicates with or is connected to at least one recess, into which one of the alignment pins is inserted.

In one embodiment, an assembly and/or clamping of the second partial ring and/or a manufacture of the recess(es) may be improved hereby.

In one embodiment, the second partial ring contacts the two facing support surfaces of the first partial ring, in particular via bearing surfaces, or it directly or immediately abuts these surfaces, in one embodiment with a press fit or under pretension. In one refinement, the second partial ring is compressed, in particularly elastically, by or between the support surfaces contacting it, and is clamped hereby, in particular in that one axial distance or an axial clearance between the support surfaces is shorter than an axial distance of the bearing surfaces of the second partial ring contacting them or a wall thickness of the second partial ring between the two support surfaces when the second partial ring is in the undeformed state. In one refinement, the second partial ring is or becomes shrink-fitted or clamped by a shrink fit between the two facing support surfaces of the first partial ring, in particular in that the first and/or second partial ring is/are temperature-controlled accordingly, in particular differently, in particular cooled or heated, for the purpose of assembly.

In one embodiment, clearance in the axial direction may be reduced or avoided hereby, and/or the fixing with the aid of the alignment pins in the radial direction may be supported in a frictionally engaged manner or relieved.

In another embodiment, an, in particular one- or multi-part, spring means becomes or is situated between the second partial ring and at least, in particular only, one of the two facing support surfaces, in particular a one- or multi-part, in particular beveled and/or arched, spring steel sheet, in particular at least partially (engaging) with a groove in the first partial ring and/or a groove in the second partial ring, through which the second partial ring becomes or is clamped, in particular elastically, between the facing support surfaces of the first partial ring and via which the second partial ring is indirectly supported in the axial direction on the corresponding one of the two facing support surfaces of the first partial ring.

In one embodiment, an assembly and/or disassembly may be improved hereby, in particular compared to a contact of the partial ring with the two facing support surfaces.

In one embodiment, the second partial ring is thus directly supported on the two axially facing support surfaces with its bearing surfaces contacting them. In another embodiment, the second partial ring is indirectly supported in the axial direction on one or both support surfaces via a one- or multi-part spring means (in each case). In one embodiment, a single- or multi-layer intermediate layer may be additionally or alternatively situated in the axial direction between the second partial ring and one or both support surfaces, these embodiments or force flows being understood, within the meaning of the present invention, in particular as a support in the axial direction on the (particular) support surface(s) of the first partial ring.

In one embodiment, one or multiple, in particular all, alignment pins are or become inserted in a frictionally engaged manner into a blind hole-like recess or a recess closed on one (end) face or a through-recess or a recess open on two (end) faces, in particular a bore, in the first partial ring and/or a blind hole-like recess or a recess closed on one (end) face or a through-recess or a recess open on two (end) faces, in particular a bore, in the second partial ring.

Due to a blind hole-like recess, an alignment pin may, in one embodiment, become or be captively secured unidirectionally in the axial direction. Due to a through-recess, an assembly may, in one embodiment, be improved.

In one embodiment, one or multiple, in particular all, alignment pins are smooth or threadless or are or become not screwed to the first and/or second partial ring.

In one embodiment, the assembly may be improved hereby, the installation space reduced and/or the reliability, in particular the strength, of the connection may be improved, compared to a screw connection.

In one embodiment, one or multiple, in particular all, alignment pins are or become secured, in particular unidirectionally, in the axial direction by an, in particular one- or multi-part securing means, which is or becomes fastened to one or both partial rings, in particular in a frictionally engaged manner, in particular by a one- or multi-part, in particular beveled and/or arched, securing plate or a one- or multi-part, wedge-like securing element or a one- or multi-part securing wedge, which, in one embodiment, is at least partially situated (in an engaged manner) in at least one groove in the first partial ring and/or at least one groove in the second partial ring, in particular becomes or is fixed therein in a frictionally engaged manner.

In one embodiment, the probability of damage to the turbomachine may be reduced hereby in the case of a failure of the alignment pin and/or the frictional engagement.

In one embodiment, the securing means may include the spring means, in particular it may simultaneously be the spring means.

In one embodiment, the same means, in particular a one- or multi-part and/or beveled and/or arched metal sheet, may implement a dual function hereby.

In one embodiment, the wedge-like securing means or the securing wedge, in particular, one or multiple parts of the securing wedge, has a decreasing wall thickness in the circumferential direction in each case. The wedge-like securing means or the securing wedge may, in one embodiment, be advantageously fixed hereby in the groove(s) in a frictionally engaged manner.

In one embodiment, the securing plate or the securing wedge becomes or is inserted into the groove(s) in the circumferential direction. In one embodiment, the assembly may be made easier hereby.

In one embodiment, an in particular (radial) inner (lateral or circumferential) contact surface of the second partial ring is situated on an, in particular (radial) outer, (lateral or circumferential) mating surface of the first partial ring, in the radial direction, in particular from the radial outside toward a rotation or (main) machine axis of the turbomachine, in one embodiment at least on one part of an axial engagement of at least one of the alignment pins in the second partial ring in the axial direction, in particular at least on the axial length of the axial engagement of at least one of the alignment pins in the second partial ring.

In one embodiment, the fixing with the aid of the alignment pins may be supported hereby in the radial direction, and/or an assembly may be improved.

In one embodiment, at least one of the support surfaces is situated, in particular formed, on a radial flange or a flange protruding in the radial direction, in particular an annular flange or a(n) (annular) collar of the first partial ring. In one embodiment, the (end) flange is situated on the end face on the first partial ring; it may, in particular, delimit or terminate the mating surface of the first partial ring. In another embodiment, the flange or collar is situated between an end face and the other of the two support surfaces, in particular on the mating surface of the first partial ring.

Additionally or alternatively, at least one of the support surfaces is situated, in particular formed, in a radial groove or one extending in the radial direction, in particular an annular or circumferential groove of the first partial ring, in particular in the groove, in which the spring means is at least partially situated or with which it engages.

Additionally or alternatively, at least one of the support surfaces in one embodiment is flat, and/or at least one of the support surfaces is curved.

In one embodiment, in particular in combination, a manufacture, assembly and/or support may be improved hereby.

In one embodiment, the first and/or second partial ring become(s) or is/are segmented in the circumferential direction, in particular in two halves.

In one embodiment, a manufacture and/or an assembly may be improved hereby.

In one embodiment, the inner ring includes a one- or multi-part radial seal, which is, in particular, integrally formed with the first and/or second partial ring or is, in particular, non-destructively, in particular integrally, detachably fastened or non-destructively fastened, in particular in a frictionally engaged and/or form-fitting manner, to the first and/or second partial ring, the radial seal being situated, in one embodiment, radially inwardly on the inner or partial ring. In one embodiment, the inner ring may thus be, in particular, a sealing ring or seal carrier.

In one embodiment, the first and second partial rings jointly form or delimit blind hole-like recesses or through-recesses, in particular through-bores, in which the guide vanes, in particular journals of the guide vanes, become or are fastened, directly or via bushings. In one embodiment, a separation plane of the first and second partial rings is situated in or through these recesses, in one embodiment at least essentially symmetrically, in particular a contact plane between one of the support surfaces of the first partial ring and a bearing surface of the second partial ring resting thereupon.

In one embodiment, a manufacture and/or an assembly may be improved hereby.

In one embodiment, the journals of the guide vanes, the bushings and/or the first and/or second partial ring(s), in particular the blind hole-like recesses or through-recesses, are at least partially coated. In one embodiment, a support, in particular adjustment, of the guide vanes, may be improved hereby.

To manufacture an axially divided inner ring described herein, in one embodiment, the first and/or second partial ring(s) is/are machined, in particular in a material-removing, in particular milling, in particular cutting, manner, and in particular the recesses for the alignment pins and/or guide vanes are manufactured, in particular finished, and/or the first and/or second partial ring(s) is/are segmented, while at least one, in particular machine-finished, of the support surfaces of the first partial ring and one, in particular machine-finished, bearing surface of the second partial ring are or become situated one on top of the other and pressed together in the axial direction. After this machining, the two partial rings may be detached from each other again, fastened to the guide vanes and connected to each other via the alignment pins.

To assemble an axially divided inner ring described herein, in one embodiment the second partial ring is elastically clamped in the axial direction between the two facing support surfaces of the first partial ring, in particular by shrink-fitting or by the spring means or by the arrangement thereof, and, in particular previously, simultaneously or subsequently fixing it on the first partial ring in the radial direction with the aid of the alignment pins. In one embodiment, the two partial rings are pushed onto each other counterclockwise in the axial direction and at least partially surround the guide vanes, in particular their bearing journals.

In one embodiment, a manufacture, assembly and/or dimensional stability may be improved hereby.

Further advantageous refinements of the present invention are derived from the following description of preferred embodiments. In a partially schematic illustration:

DETAILED DESCRIPTION

Figure 1:
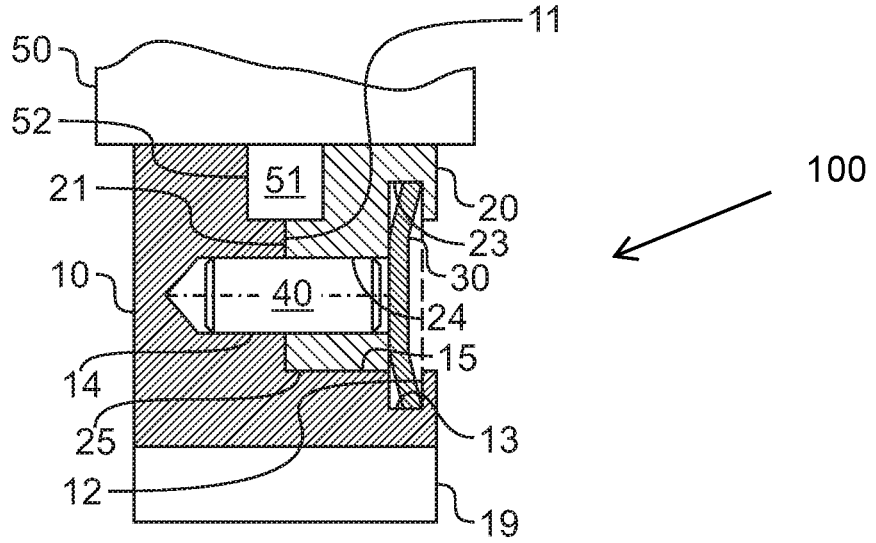
FIG. 1 shows a part of a guide baffle of a turbomachine, including an inner ring according to one embodiment of the present invention, in a meridian section.

FIG. 1 shows part of a guide baffle of a turbomachine 100, including an inner ring according to one embodiment of the present invention in a meridian section, in which a rotation or (main) machine axis is situated (horizontally in FIG. 1).

Figure 4:
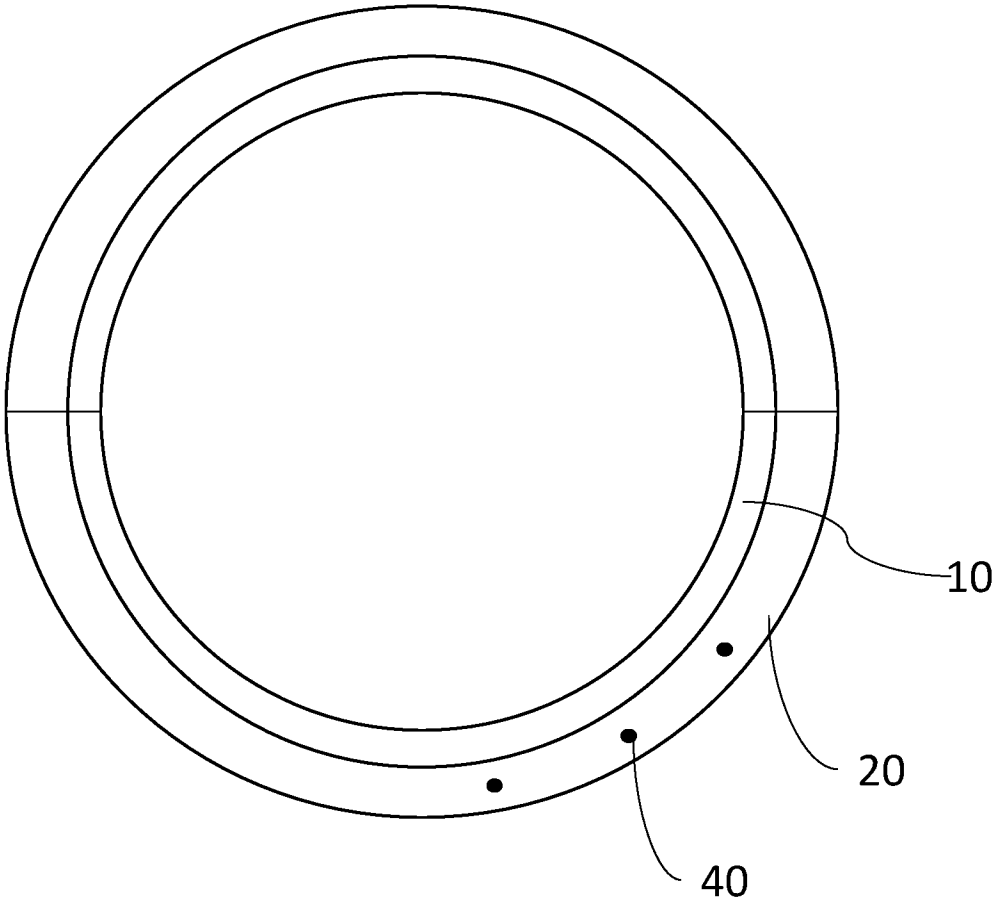
FIG. 4 shows a highly schematicized cross-section to show the circumferential nature of the turbomachine 100.

The inner ring includes a first partial ring 10 and a second partial ring 20 and is thus divided (in two) axially or in the axial direction (horizontally in FIG. 1). The inner ring or partial rings 10, 20 is/are (each) segmented into two halves in the circumferential direction, as shown highly schematicized in FIG. 4.

A radial seal 19 is situated radially inwardly (at the bottom of FIG. 1) on first partial ring 10.

Figure 3:
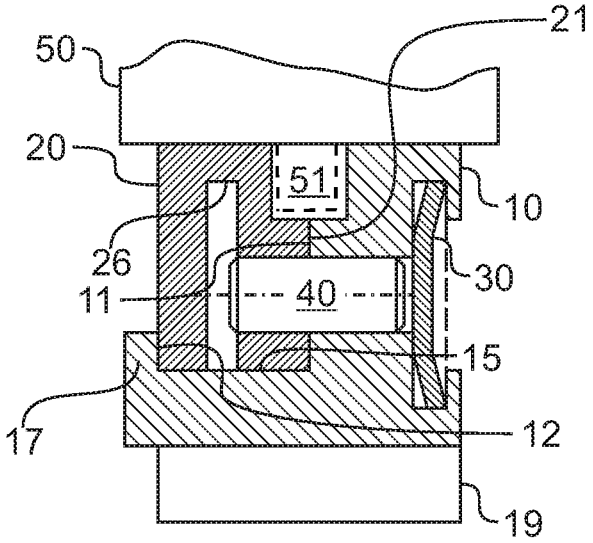
FIG. 3 shows a part of a guide baffle of a turbomachine, including an inner ring according to another embodiment of the present invention, in a representation corresponding to FIGS. 1 and 2.

First and second partial rings 10, 20 together form blind hole-like bores 52, in which journals 51 of adjustable guide vanes 50 are rotatably supported, in one embodiment directly and in another embodiment via bushings, shown schematically in FIG. 3 by dotted lines.

Second partial ring 20 is fixed on first partial ring 10 in the radial direction (vertically in FIG. 1) with the aid of multiple alignment pins 40 distributed in the circumferential direction, which are inserted in a frictionally engaged manner into through-bores 24 in second partial ring 20 and partially therethrough into blind hole-like bores 14 in first partial ring 10.

Second partial ring 20 is supported in the axial direction on two axially facing support surfaces 11, 12 of first partial ring 10, supporting surface 12 being situated in a radial groove 13 of first partial ring 10.

A bearing surface 21 of second partial ring 20 contacts support surface 11 of first partial ring 10, while a spring means 30 is situated between second partial ring 20 and other support surface 12, through or via which second partial ring 20 is supported in the axial direction on other support surface 12 of the two axially facing support surfaces 11, 12 of first partial ring 10 and is clamped hereby therebetween in the axial direction.

This spring means 30 is partially situated or fastened in a frictionally engaged manner in groove 13 of first partial ring 10 and partially in a groove 23 of second partial ring 20 and thus simultaneously acts as a securing means which secures alignment pins 40 in the axial direction.

A contact surface 25 of second partial ring 20 rests from the radial outside (from the top in FIG. 1) on a mating surface 15 of first partial ring 10.

To manufacture the inner ring, support surface 11 and mating surface 15 of first partial ring 10 and bearing surface 21 and contact surface 25 of second partial ring 20 are initially machine-finished, situated one on top of the other, and both partial rings 10, 20 are clamped to each other in the axial direction with the aid of clamping means, which are not illustrated, so that support surface 11 and bearing surface 21 are pressed against each other.

In this state bores 14, 24, 52 are finished and the two partial rings 10, 20 are each segmented into two halves in the circumferential direction.

The two partial rings 10, 20 are subsequently detached from each other again and pushed against each other counterclockwise in the axial direction for assembly, whereby they surround bearing journals 51 of guide vanes 50. Alignment pins 40 are then inserted and spring means 30 subsequently fastened in grooves 13, 23.

Figure 2:
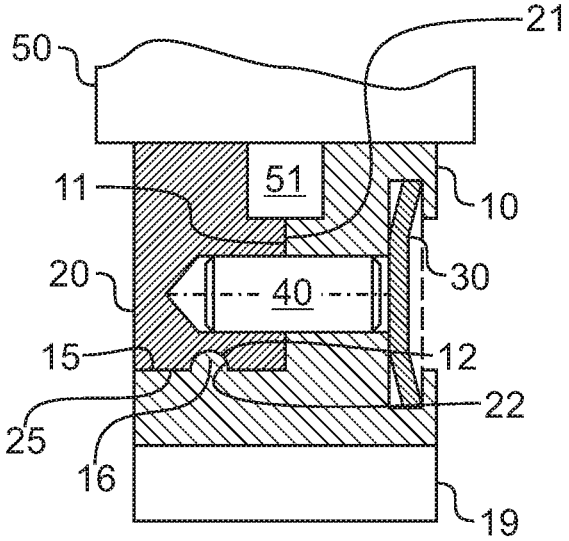
FIG. 2 shows a part of a guide baffle of a turbomachine, including an inner ring according to another embodiment of the present invention, in a representation corresponding to FIG. 1.

FIG. 2 shows a part of a guide baffle of a turbomachine, including an inner ring according to another embodiment of the present invention, in a representation corresponding to FIG. 1. Corresponding features are identified by identical reference numerals, so that reference is hereby made to the preceding description and only the differences are discussed below.

In the embodiment in FIG. 2, support surface 12 of first partial ring 10 is curved and situated not in a groove but on a radial collar 16, which, in turn, is situated on mating surface 15 of first partial ring 10.

Second partial ring 20, which in the embodiment in FIG. 2 is supported directly on support surfaces 11, 12 of first partial ring 10, may be or become clamped therebetween, in that an axial distance between support surfaces 11, 12 is slightly shorter than an axial distance between bearing surface 21, 22 contacting them in undeformed second partial ring 20.

To manufacture the inner ring, support surfaces 11, 12 and mating surface 15 of first partial ring 10 and bearing surfaces 21, 22 and contact surface 25 of second partial ring 20 are initially finished, situated one on top of the other, and both partial rings 10, 20 are clamped to each other in the axial direction with the aid of clamping means, which are not illustrated.

In this state bores 14, 24, 52 are finished and the two partial rings 10, 20 are each segmented into two halves in the circumferential direction.

The two partial rings 10, 20 are subsequently detached from each other again and pushed against each other counterclockwise in the axial direction for assembly, whereby they surround bearing journals 51 of guide vanes 50, the curvature of support surface 12 favoring an assembly. Alignment pins 40 are then inserted and securing means 30 subsequently fastened in grooves of first partial ring 10.

FIG. 3 shows a part of a guide baffle of a turbomachine, including an inner ring according to another embodiment of the present invention, in a representation corresponding to FIGS. 1 and 2. Corresponding features are identified by identical reference numerals, so that reference is hereby made to the preceding description and only the differences are discussed below.

In the embodiment in FIG. 3, support surface 12 of first partial ring 10 is flat and situated not in a groove but on a radial end flange 17, which delimits mating surfaces 15 of first partial ring 10.

Second partial ring 20, which in the embodiment in FIG. 3 is also directly supported on support surfaces 11, 12 of first partial ring 10, is clamped in the axial direction therebetween with the aid of a shrink or press fit.

For this purpose, it has an annular groove 26 radially on the inside for reducing its stiffness in the axial direction.

To manufacture the inner ring, axially facing support surfaces 11, 12 and mating surface 15 of first partial ring 10 and the bearing surfaces (only bearing surface 21 is provided with a reference numeral in FIG. 3) and the contact surface of second partial ring 20 are finished, situated one on top of the other, and both partial rings 10, 20 are clamped to each other in the axial direction by shrinking on second partial ring 20.

In this state bores 14, 24, 52 are finished and the two partial rings 10, 20 are each segmented into two halves in the circumferential direction.

The two partial rings 10, 20 are subsequently detached from each other again and pushed against each other counterclockwise in the axial direction for assembly, whereby they surround bearing journals 51 of guide vanes 50, the limited radial height of end flange 17 favoring a shrinking on of second partial ring 20 for assembly. Alignment pins 40 are then inserted and securing means 30 subsequently fastened in grooves of first partial ring 10.

While the description above explains exemplary embodiments, it should be pointed out that a large number of modifications are possible.

In a modification indicated by the dash-dot line in FIGS. 1 through 3, securing means 30 may also be designed as a one- or multi-part wedge having a wall thickness which increases in the circumferential direction, which or whose parts is/are inserted into grooves 13, 23 in the circumferential direction and are or become fixed therein in a frictionally engaged manner.

Moreover, it should be pointed out that the exemplary embodiments are only examples which are not intended to limit the scope of protection, the applications and the design in any way. Rather, the description above gives those skilled in the art a guideline for implementing at least one exemplary embodiment, various modifications being possible, in particular with respect to the function and arrangement of the described components, without departing from the scope of protection as it is derived from the claims and feature combinations equivalent to the claims.

LIST OF REFERENCE NUMERALS

10 first partial ring
11, 12 support surface
13 groove
14 bore
15 mating surface
16 collar
17 end flange
19 seal
20 second partial ring
21, 22 bearing surface
23 groove
24 bore
25 contact surface
26 annular groove
30 spring and/or securing means
40 alignment pin
50 guide vane
51 journal
52 bore
100 turbomachine

What is claimed is:

1. An axially divided inner ring for fastening to guide vanes of a turbomachine, the inner ring comprising:

a first partial ring; and a second partial ring axially divided from the first partial ring and supported in an axial direction directly or indirectly on two axially facing support surfaces of the first partial ring and fixed on the first partial ring in a radial direction; and wherein the second partial ring is clamped in the axial direction between the two facing support surfaces of the first partial ring.

2. The inner ring as recited in claim 1 wherein the second partial ring has at least one annular groove for reducing a stiffness in the axial direction.

3. The inner ring as recited in claim 1 wherein the second partial ring contacts the two facing support surfaces of the first partial ring, or a spring is situated between the second partial ring and at least one of the two facing support surfaces for clamping the second partial ring between the support surfaces.

4. The inner ring as recited in claim 1 wherein at least one of the alignment pins is inserted into a blind hole-recess or through-recess in the first or second partial ring in a frictionally engaged manner or is secured in the axial direction by a securing means fastened on at least one of the partial rings.

5. The inner ring as recited in claim 4 wherein the securing means includes a spring or a wedge.

6. The inner ring as recited in claim 4 wherein the securing means is a spring.

7. The inner ring as recited in claim 1 wherein a contact surface of the second partial ring rests on a mating surface of the first partial ring in the radial direction.

8. The inner ring as recited in claim 7 wherein the contact surface is radially on an outside of the mating surface.

9. The inner ring as recited in claim 1 wherein at least one of the support surfaces is situated on a radial flange or in a radial groove of the first partial ring.

10. The inner ring as recited in claim 1 wherein the first or second partial ring is segmented in the circumferential direction.

11. The inner ring as recited in claim 1 further comprising a radial seal integrally formed with the first or second partial ring.

12. The inner ring as recited in claim 1 further comprising a radial seal fastened on the first or second partial ring.

13. The inner ring as recited in claim 1 wherein the first and second partial rings together form blind hole-recesses or through-recesses for fastening to the guide vanes.

14. The inner ring as recited in claim 13 wherein the recesses or the through-recesses are coated, as are the guide vanes.

15. The inner ring as recited in claim 13 further comprising bushings in the recesses for supporting the guide vanes.

16. A guide baffle for a turbomachine comprising the axially divided inner ring as recited in claim 1 and the guide vanes, the inner ring being fastened to the guide vanes.

17. The guide baffle as recited in claim 16 wherein the guide vanes are adjustable.

18. A turbomachine comprising at least one compressor or turbine stage having the axially divided inner ring as recited in claim 1.

19. A gas turbine comprising the turbomachine as recited in claim 18.

20. A compressor or turbine stage of a gas turbine comprising the axially divided inner ring as recited in claim 1.

21. A method for assembling an axially divided inner ring as recited in claim 1, the second partial ring being clamped in the axial direction between the two facing support surfaces of the first partial ring and fixed in the radial direction on the first partial ring with the aid of the alignment pins.

22. A method for manufacturing an axially divided inner ring as recited in claim 1 wherein the first or second partial ring is machined, in particular recesses for the alignment pins or guide vanes being manufactured or the partial ring being segmented, while at least one, in particular finished, of the support surfaces of the first partial ring and an, in particular, finished bearing surface of the second partial ring being situated on top of the other and pressed against each other.

* * * * *